US011776769B2

(12) United States Patent
Chen et al.

(10) Patent No.: US 11,776,769 B2
(45) Date of Patent: Oct. 3, 2023

(54) KEY STRUCTURE

(71) Applicant: Acer Incorporated, New Taipei (TW)

(72) Inventors: Hung-Chi Chen, New Taipei (TW); Cheng-Han Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 17/852,295

(22) Filed: Jun. 28, 2022

(65) Prior Publication Data

US 2023/0127164 A1 Apr. 27, 2023

(30) Foreign Application Priority Data

Oct. 25, 2021 (TW) ..... 110139452

(51) Int. Cl.
*H01H 3/12* (2006.01)
*H01H 13/14* (2006.01)

(52) U.S. Cl.
CPC ..... *H01H 3/125* (2013.01); *H01H 13/14* (2013.01); *H01H 2227/018* (2013.01); *H01H 2227/022* (2013.01)

(58) Field of Classification Search
CPC .. H01H 3/125; H01H 13/14; H01H 2227/018; H01H 2227/022; H01H 3/12; H01H 13/70; H01H 13/7065; H01H 13/7073; H01H 13/84; H01H 13/85
See application file for complete search history.

(56) References Cited

U.S. PATENT DOCUMENTS 6,570,113 B2 * 5/2003 Yu ..... H01H 3/125 200/344
2001/0011999 A1 * 8/2001 Mochizuki ..... H01H 3/122 345/168

* cited by examiner

*Primary Examiner* — Lheiren Mae A Caroc
(74) *Attorney, Agent, or Firm* — JCIPRNET

(57) ABSTRACT

A key structure, including a base plate, a thin film circuit, a dome switch, a scissor structure, an elastic piece, and a keycap, is provided. The thin film circuit is disposed on the base plate. The dome switch is disposed on the thin film circuit. The scissor structure is disposed on the base plate, wherein the scissor structure includes a first support and a second support pivotally connected to the first support, and the second support surrounds the first support. The first support has a trigger part, and the second support has a chamber disposed corresponding to the trigger part. The elastic piece is engaged inside the chamber, wherein the elastic piece has an interfering part located outside the chamber, and the interfering part is located on a moving path of the trigger part. The keycap is disposed on the scissor structure and the dome switch.

10 Claims, 9 Drawing Sheets

KEY STRUCTURE

CROSS-REFERENCE TO RELATED APPLICATION

This application claims the priority benefit of Taiwan application serial no. 110139452, filed on Oct. 25, 2021. The entirety of the above-mentioned patent application is hereby incorporated by reference herein and made a part of this specification.

BACKGROUND

Technical Field

The disclosure relates to a key structure, and particularly relates to a key structure applied to a keyboard.

Description of Related Art

As a common physical operating interface, the keyboard is widely applied to desktop computers, notebook computers, or other electronic devices. According to differences in structural design, operating stroke, trigger mechanism, etc., the keyboard may be roughly divided into thin film keyboard and mechanical keyboard, and the scissor keyboard is a common thin film keyboard. Generally speaking, the mechanical keyboard is provided with an elastic piece inside the shaft body of a key. When the user presses the key, the elastic piece is squeezed to elastically deform and emit a sound, so as to enhance the operating experience of the user. However, limited by the operating stroke of the shaft body of the key, the overall thickness of the mechanical keyboard is much greater than the overall thickness of the scissor keyboard, so the mechanical keyboard cannot meet the design requirements of lightness and thinness.

SUMMARY

The disclosure provides a key structure, which not only meets the design requirements of lightness and thinness, but also helps to improve the operating experience of the user.

The disclosure provides a key structure, which includes a base plate, a thin film circuit, a dome switch, a scissor structure, an elastic piece, and a keycap. The thin film circuit is disposed on the base plate. The dome switch is disposed on the thin film circuit. The scissor structure is disposed on the base plate. The scissor structure includes a first support and a second support pivotally connected to the first support, and the second support surrounds the first support. The first support has a trigger part, and the second support has a chamber disposed corresponding to the trigger part. The elastic piece is engaged inside the chamber. The elastic piece has an interfering part located outside the chamber, and the interfering part is located on a moving path of the trigger part. The keycap is disposed on the scissor structure and the dome switch.

Based on the above, the key structure of the disclosure integrates an acoustic structure with the scissor structure. During the process of lifting and lowering the scissor structure, the acoustic structure may be triggered to emit a sound, so as to enhance the operating experience (such as the auditory experience) of the user. In addition, compared with a key structure adopting a mechanical shaft, the key structure of the disclosure adopts the scissor structure, so the key structure of the disclosure can meet the design requirements of lightness and thinness.

In order for the features and advantages of the disclosure to be more comprehensible, the following specific embodiments are described in detail in conjunction with the accompanying drawings.

DETAILED DESCRIPTION OF DISCLOSED EMBODIMENTS

Figure 1:
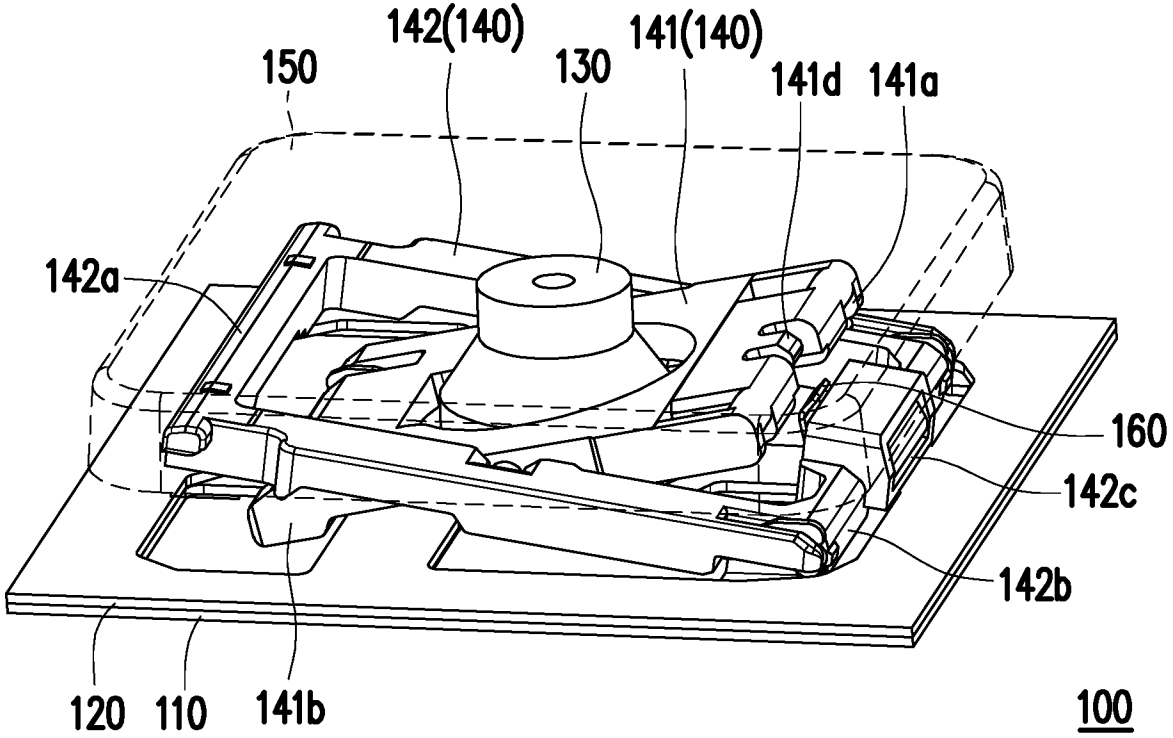
FIG. 1 is a schematic view of a key structure according to an embodiment of the disclosure.
Figure 2A:
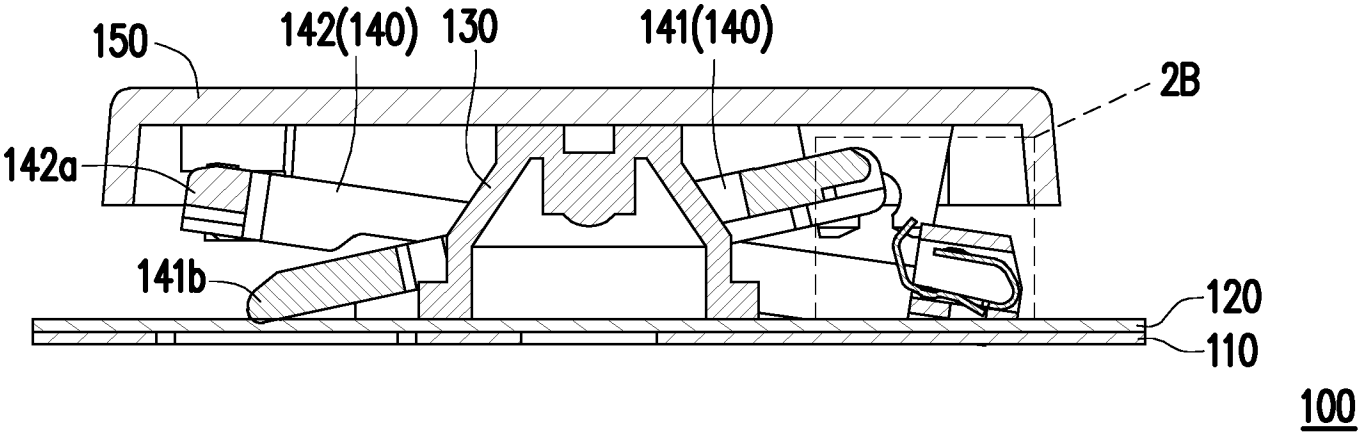
FIG. 2A is a schematic cross-sectional view of the key structure of FIG. 1.
Figure 2B:
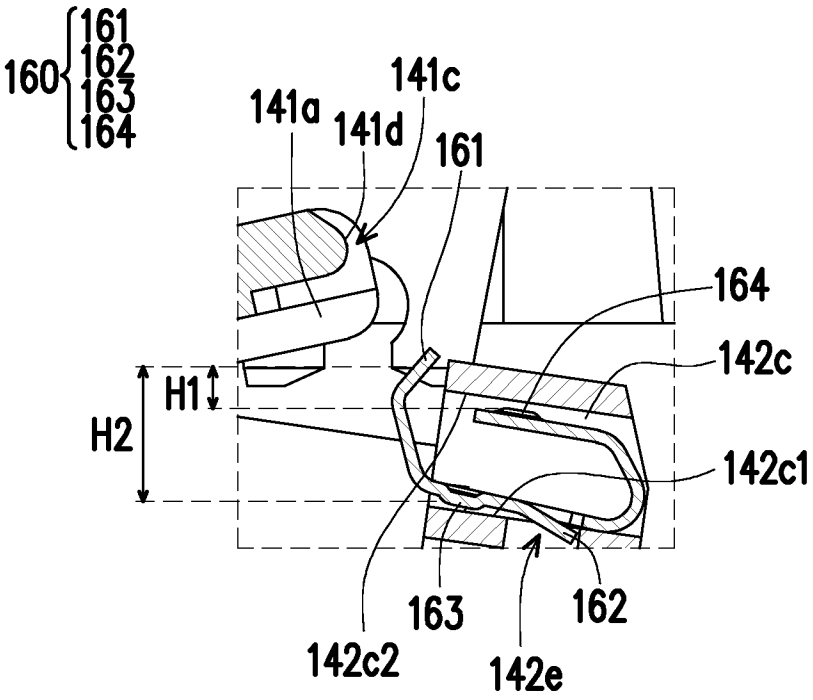
FIG. 2B is an enlarged view of the portion, labeled '2B' of FIG. 2A.

FIG. 1 is a schematic view of a key structure according to an embodiment of the disclosure. FIG. 2A is a schematic cross-sectional view of the key structure of FIG. 1. FIG. 2B is an enlarged view of the portion, labeled '2B' of FIG. 2A. In order to clearly show the internal structural configuration, a keycap 150 of FIG. 1 is drawn with dotted lines. Please refer to FIG. 1, FIG. 2A and FIG. 2B. In the embodiment, a key structure 100 may be applied to a keyboard and includes a base plate 110, a thin film circuit 120, a dome switch 130, a scissor structure 140, and the keycap 150. The thin film circuit 120 is disposed on the base plate 110, and the keycap 150 is disposed above the thin film circuit 120. The dome switch 130 is disposed on the thin film circuit 120 and is located between the thin film circuit 120 and the keycap 150. In addition, opposite ends of the dome switch 130 respectively abut against the thin film circuit 120 and the keycap 150.

The keycap 150 is disposed on the dome switch 130 and the scissor structure 140, and the scissor structure 140 includes a first support 141 and a second support 142 pivotally connected to each other. Furthermore, the first support 141 may be an inner support surrounding the dome switch 130, and the second support 142 may be an outer support surrounding the first support 141. The first support 141 has a first end 141*a* and a second end 141*b* opposite to each other, and correspondingly, the second support 142 has a first end 142*a* and a second end 142*b* opposite to each other. The first end 141*a* of the first support 141 and the first end 142*a* of the second support 142 are connected to the keycap 150, and the second end 141*b* of the first support 141 and the second end 142*b* of the second support 142 are connected to the base plate 110.

In the embodiment, the key structure 100 integrates an acoustic structure with the scissor structure 140. During the process of lifting and lowering the scissor structure 140, the acoustic structure may be triggered to emit a sound, so as to enhance the operating experience (such as the auditory experience) of the user. Furthermore, the acoustic structure includes a trigger part 141*d* located on the first support 141 and an elastic piece 160 disposed on the second support 142, and a portion of the elastic piece 160 is located on a moving path of the trigger part 141*d*. During the process of lifting and lowering the scissor structure 140, the trigger part 141*d* moves through the elastic piece 160 and pushes the elastic piece 160, so that the elastic piece 160 taps the second support 142 to emit a sound. Compared with a key structure adopting a mechanical shaft, the key structure 100 adopts the scissor structure 140, so the key structure 100 can meet the design requirements of lightness and thinness.

As shown in FIG. 1, FIG. 2A and FIG. 2B, the trigger part 141*d* may be a trigger bump on the first end 141*a* of the first support 141, and the elastic piece 160 is disposed on the second end 142*b* of the second support 142. Furthermore, the second support 142 has a chamber 142*c* disposed corresponding to the trigger part 141*d*, and the chamber 142*c* is located on the second end 142*b* of the second support 142.

Furthermore, the elastic piece 160 is engaged inside the chamber 142*c* and has an interfering part 161 located outside the chamber 142*c*.

On the other hand, the first support 141 further has a groove 141*c* located on the first end 141*a*, wherein the trigger part 141*d* is located inside the groove 141*c*, and an outward protruding length of the trigger part 141*d* is less than the depth of the groove 141*c*, that is, the trigger part 141*d* does not protrude beyond the groove 141*c*.

Figure 3A:
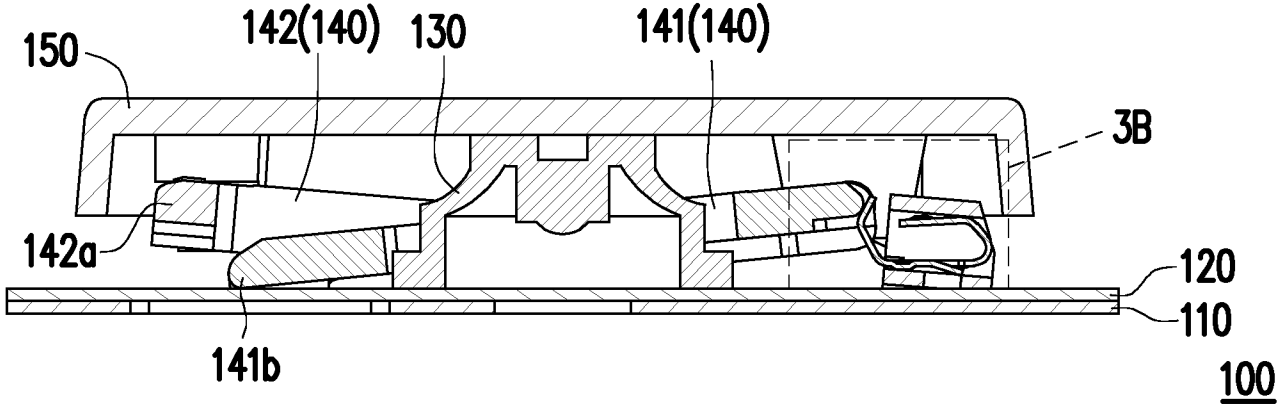
FIG. 3A and FIG. 4A are schematic cross-sectional views of the key structure of FIG. 2A when pressed down.
Figure 3B:
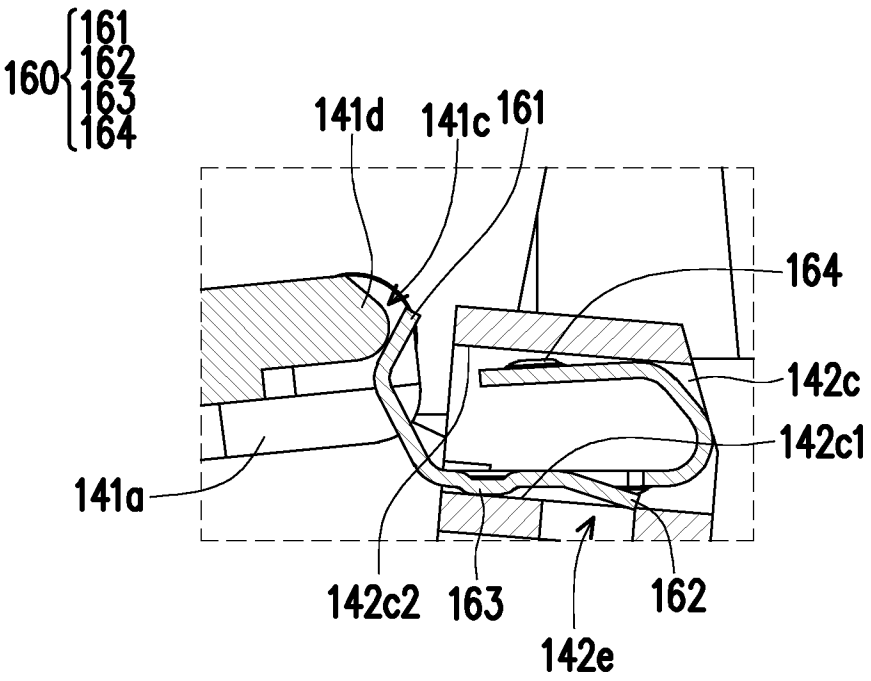
FIG. 3B is an enlarged view of the portion, labeled '3B' of FIG. 3A.
Figure 4A:
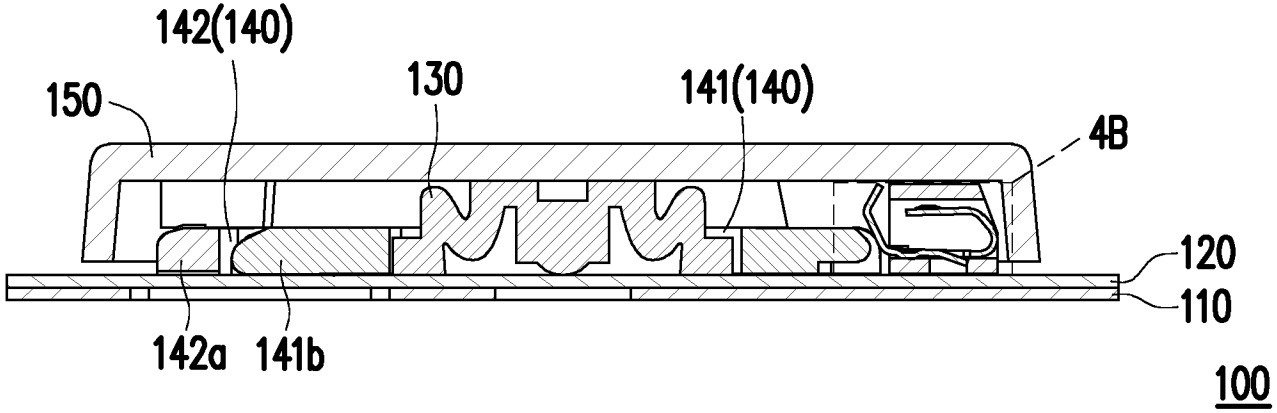
Figure 4B:
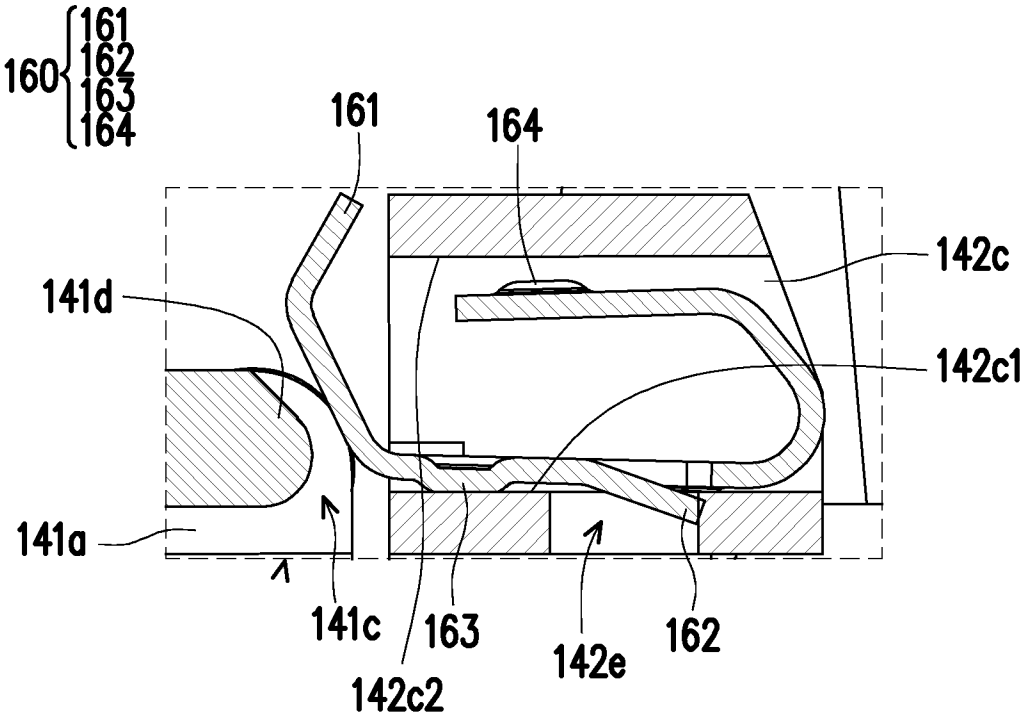
FIG. 4B is an enlarged view of the portion, labeled '4B of FIG. 4A.

FIG. 3A and FIG. 4A are schematic cross-sectional views of the key structure of FIG. 2A when pressed down. FIG. 3B is an enlarged view of the portion, labeled '3B' of FIG. 3A. FIG. 4B is an enlarged view of the portion, labeled '4B of FIG. 4A. Please refer to FIG. 2A, FIG. 2B, FIG. 3A, FIG. 3B, FIG. 4A and FIG. 4B. During the process of the first end 141*a* of the first support 141 moving toward the base plate 110, the trigger part 141*d* synchronously moves toward the base plate 110. The trigger part 141*d* moves through the interfering part 161 of the elastic piece 160 and pushes the interfering part 161 of the elastic piece 160, so that the elastic piece 160 is elastically deformed and rotates in the chamber 142*c*. After rotating, the elastic piece 160 taps an inner wall surface (for example, a bottom surface 142*cl*) of the chamber 142*c* and emits a first sound. On the other hand, the chamber 142*c* may be used as a resonant cavity to amplify the sound generated when the elastic piece 160 taps the bottom surface 142*cl* of the chamber 142*c*.

Figure 5A:
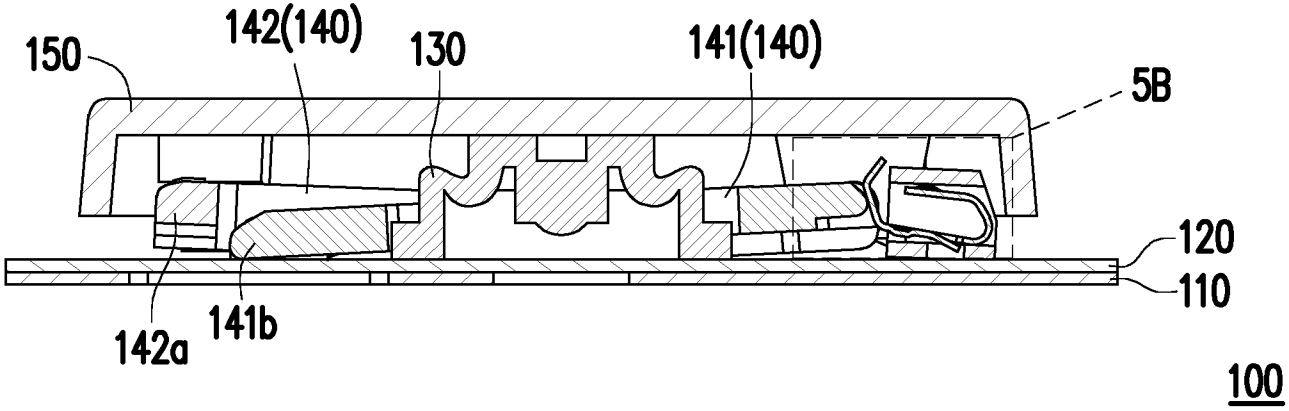
FIG. 5A is a schematic cross-sectional view of the key structure of FIG. 4A when lifted up.
Figure 5B:
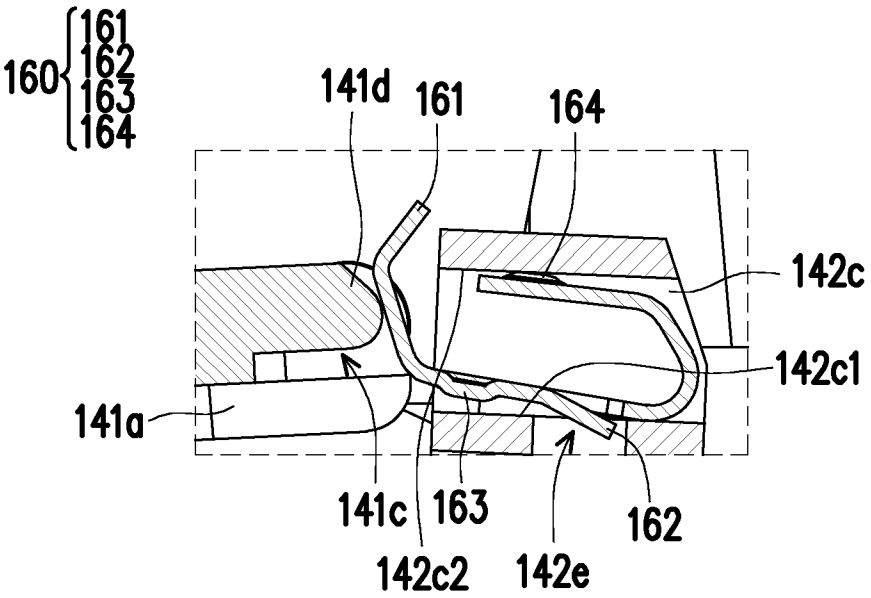
FIG. 5B is an enlarged view of the portion, labeled '5B' of FIG. 5A.

FIG. 5A is a schematic cross-sectional view of the key structure of FIG. 4A when lifted up. FIG. 5B is an enlarged view of the portion, labeled '5B' of FIG. 5A. Please refer to FIG. 4A, FIG. 4B, FIG. 5A and FIG. 5B. During the process of the first end 141*a* of the first support 141 moving away from the base plate 110, the trigger part 141*d* synchronously moves away from the base plate 110. The trigger part 141*d* moves through the interfering part 161 of the elastic piece 160 and pushes the interfering part 161 of the elastic piece 160, so that the elastic piece 160 is elastically deformed and rotates in the chamber 142*c*. After rotating, the elastic piece 160 taps an inner wall surface (for example, a top surface 142*c*2) of the chamber 142*c* and emits a second sound. On the other hand, the chamber 142*c* may be used as a resonant cavity to amplify the sound generated when the elastic piece 160 taps the top surface 142*c*2 of the chamber 142*c*.

In other words, during the process of pressing down and lifting up the key structure 100, the elastic piece 160 is pushed twice by the first support 141 to successively tap the second support 142 twice to emit two operating sounds, as shown in FIG. 2A to FIG. 5B.

Please refer to FIG. 2A and FIG. 2B. In the embodiment, the elastic piece 160 further has a positioning hook 162, a first contact protrusion 163, and a second contact protrusion 164, wherein the second support 142 further has a positioning recess 142*e* connected to the chamber 142*c*, and the positioning hook 162 is engaged with the positioning recess 142*e* to prevent the elastic piece 160 from easily ejecting out of the chamber 142*c*. In addition, the first contact protrusion 163 faces the bottom surface 142*cl* of the chamber 142*c*, and the second contact protrusion 164 faces the top surface 142*c*2 of the chamber 142*c*.

In the horizontal direction, the first contact protrusion 163 and the second contact protrusion 164 are located between the interfering part 161 and the positioning hook 162, wherein the first contact protrusion 163 is located between the interfering part 161 and the second contact protrusion 164, and the second contact protrusion 164 is located between the first contact protrusion 163 and the positioning hook 162. On the other hand, the second contact protrusion 164 is disposed relative to the positioning hook 162 and the first contact protrusion 163. In the vertical direction, there is a height difference between the second contact protrusion 164 and the first contact protrusion 163, and a height difference H1 between the interfering part 161 and the second contact protrusion 164 is less than a height difference H2 between the interfering part 161 and the first contact protrusion 163. In contrast, in the vertical direction, a height difference between the positioning hook 162 and the second contact protrusion 164 is greater than a height difference between the positioning hook 162 and the first contact protrusion 163.

As shown in FIG. 2A and FIG. 2B, the first contact protrusion 163 of the elastic piece 160 is separated from the bottom surface 142*cl* of the chamber 142*c*. As shown in FIG. 3A, FIG. 3B, FIG. 4A and FIG. 4B, during the process of the first end 141*a* of the first support 141 moving toward the base plate 110, the trigger part 141*d* synchronously moves toward the base plate 110. The trigger part 141*d* moves through the interfering part 161 of the elastic piece 160 and pushes the interfering part 161 of the elastic piece 160, so that the first contact protrusion 163 rotates with the positioning hook 162 as the pivot point and taps the bottom surface 142*cl* of the chamber 142*c* to emit the first sound.

As shown in FIG. 4A, FIG. 4B, FIG. 5A and FIG. 5B, during the process of the first end 141*a* of the first support 141 moving away from the base plate 110, the trigger part 141*d* synchronously moves away from the base plate 110. The trigger part 141*d* moves through the interfering part 161 of the spring piece 160 and pushes the interfering part 161 of the spring piece 160, so that the second contact protrusion 164 rotates with the positioning hook 162 as the pivot point and taps the top surface 142*c*2 of the chamber 142*c* to emit the second sound.

In summary, the key structure of the disclosure integrates the acoustic structure with the scissor structure. During the process of lifting and lowering the scissor structure, the acoustic structure may be triggered to emit a sound, so as to enhance the operating experience (such as the auditory experience) of the user. Furthermore, the acoustic structure includes the trigger part located on the first support and the elastic piece disposed on the second support, and a portion of the elastic piece is located on the moving path of the trigger part. During the process of lifting and lowering the scissor structure, the trigger part moves through the elastic piece and pushes the elastic piece, so that the elastic piece taps the second support to emit a sound. In addition, compared with the key structure adopting the mechanical shaft, the key structure of the disclosure adopts the scissor structure, so the key structure of the disclosure can meet the design requirements of lightness and thinness.

Although the disclosure has been disclosed in the above embodiments, the embodiments are not intended to limit the disclosure. Persons skilled in the art may make some changes and modifications without departing from the spirit and scope of the disclosure. The protection scope of the disclosure shall be defined by the appended claims.

What is claimed is:

1. A key structure, comprising:

a base plate;

a thin film circuit, disposed on the base plate;

a dome switch, disposed on the thin film circuit;

a scissor structure, disposed on the base plate and comprising a first support and a second support pivotally connected to the first support, wherein the second support surrounds the first support, the first support has a trigger part, and the second support has a chamber disposed corresponding to the trigger part;

an elastic piece, engaged inside the chamber, wherein the elastic piece has an interfering part located outside the chamber, and the interfering part is located on a moving path of the trigger part; and a keycap, disposed on the scissor structure and the dome switch.

2. The key structure according to claim 1, wherein opposite ends of the dome switch respectively contact the thin film circuit and the keycap.

3. The key structure according to claim 1, wherein opposite ends of the first support are respectively connected to the base plate and the keycap, and opposite ends of the second support are respectively connected to the base plate and the keycap.

4. The key structure according to claim 3, wherein the trigger part is located on an end of the first support connected to the keycap, and the chamber is located on an end of the second support connected to the base plate.

5. The key structure according to claim 3, wherein the first support further has a groove, the groove is located on an end of the first support connected to the keycap, and the trigger part is located inside the groove.

6. The key structure according to claim 1, wherein the second support further has a positioning recess connected to the chamber, the elastic piece further has a positioning hook, and the positioning hook is engaged inside the positioning recess.

7. The key structure according to claim 6, wherein the elastic piece further has a first contact protrusion located between the interfering part and the positioning hook, the first contact protrusion faces a bottom surface of the chamber, the first contact protrusion is separated from the bottom surface of the chamber, and during a process of the trigger part moving toward the base plate and pushing the interfering part, the first contact protrusion moves toward the bottom surface of the chamber and contacts the bottom surface.

8. The key structure according to claim 7, wherein the elastic piece further has a second contact protrusion located between the interfering part and the positioning hook, the second contact protrusion faces a top surface of the chamber, the second contact protrusion is separated from the top surface of the chamber, and during a process of the trigger part moving away from the base plate, the second contact protrusion moves toward the top surface of the chamber and contacts the top surface.

9. The key structure according to claim 8, wherein the second contact protrusion is located between the first contact protrusion and the positioning hook in a horizontal direction.

10. The key structure according to claim 8, wherein a height difference between the interfering part and the second contact protrusion is less than a height difference between the interfering part and the first contact protrusion.

* * * * *